United States Patent [19]

Abraham

[11] 4,090,419

[45] May 23, 1978

[54] HAND GRIP FOR REMOVING SCREWTOP LIDS

[76] Inventor: Garnett Abraham, 215 Manor Rd., Staten Island, N.Y. 10314

[21] Appl. No.: 782,591

[22] Filed: Mar. 29, 1977

[51] Int. Cl.[2] ..... B67B 7/00
[52] U.S. Cl. ..... 81/3.4
[58] Field of Search ..... 81/3.4

[56] References Cited

U.S. PATENT DOCUMENTS

| | | | |
|---|---|---|---|
| 2,083,957 | 6/1937 | Marsella et al. | 81/3.4 |
| 2,235,313 | 3/1941 | Cleveland | 81/3.4 |
| 2,985,044 | 5/1961 | Gill | 81/3.4 |

*Primary Examiner*—James L. Jones, Jr.
*Assistant Examiner*—James G. Smith
*Attorney, Agent, or Firm*—Allison C. Collard

[57] ABSTRACT

A lid removing device for removing lids from containers, consisting of a flat, resilient sheet of material having a plurality of circular segments, concentrically formed within the sheet. The innermost segment has a central aperture and each of the circular segments are integrally coupled to the outermost circular segment. There is also formed a tab on the outermost segment, with a hole to allow the device to be hung up. Each of the circular segments has a common coupling to join them together and hold them to the tab. The device is preferably constructed from a sheet of resilient material.

4 Claims, 5 Drawing Figures

HAND GRIP FOR REMOVING SCREWTOP LIDS

This invention relates to an improved hand grip for removing screwtop lids from containers.

More specifically, the present invention relates to a multi-diameter, anti-friction hand grip, which is capable of fitting around a plurality of different diameter screwtop lids for containers of different sizes.

In the manufacture of certain food items, which are packaged in containers having lids, it is often difficult, if not impossible, to manually unscrew the lid from the container without the help of an external tool or device, such as a pliers or hand grip. It is therefore customary for persons in a kitchen to keep either a pair of channel-lock pliers available for removing lids or a friction reducing pad, such as a rubber pad that is capable of fitting over the lid when the container or jar is first opened. The use of mechanical tools, such as pliers, requires some skill by the user in not damaging the container, particularly if the container is glass, when the contents are opened. Friction reducing pads, such as those made out of rubber do not always provide the best grip on the jar lid and have a tendency to slip when being used. Moreover, these friction reducing pads require a great finger strength by the user in maintaining the pad snug against the surface of the lid, while the lid is being twisted.

Accordingly, the present invention provides an improved lid-removing device, which is capable of fitting completely around the periphery of a container top or lid, so that no manual pressure is required to maintain the device against the lid, while it is being twisted. In a preferred embodiment, the invention consists of a circular pad having partial circular cut-outs or segments of different diameters, concentrically formed therein, in order to accommodate lid covers of different peripheries or diameters. A tab portion is integrally formed along the edge of the device and includes an aperture to enable the user to hand the lid-removing device of the present invention against a wall when not in use.

It is therefore an object, according to the present invention, to provide a lid-removing device, consisting of a plurality of circular segments concentrically disposed, which are capable of fitting on lids of different diameters.

It is another object, according to the present invention, to provide a lid-removing device, which is simple in design, easy to manufacture and inexpensive in cost.

Other objects and features of the present invention will become apparent from the following detailed description considered in connection with the accompanying drawing, which discloses the embodiments of the invention. It is to be understood, however, that the drawing is designed for the purpose of illustration only and not as a definition of the limits of the invention.

In the drawing, wherein the same reference numerals denote similar elements throughout the several views.

Figure 1:
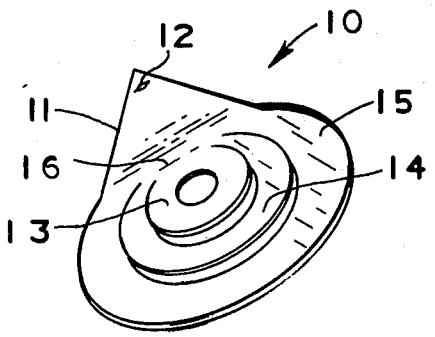
FIG. 1 is a perspective view, showing the lid-removing device, according to the invention.
Figure 2:
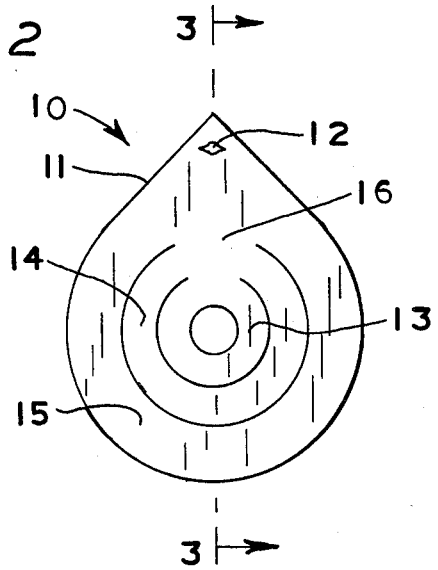
FIG. 2 is a top plan view thereof.

Referring to FIGS. 1 and 2, there is shown the lid-removing device 10, according to the invention, preferably constructed from a thin rubber or resilient sheet, having stamped out circular portions 13, 14 and 15, consisting of circular segments, which are concentric to each other, and of increasing diameter. Circular segment 13 has a centrally disposed hole, which is preferably concentric to all of the circular segments. Formed on the periphery of the device on the largest of the circular segments is a tab 11, which preferably extends to a point and includes a small aperture 12, to allow the device to be hung from a spike or nail, if desired.

In manufacturing the lid-removing device of the present invention, a central channel 16 is left uncut to form a common coupling, so that the inner circular segments 13 and 14 remain integrally joined to the outer circular segment 15.

In an actual embodiment, the diameter of outer segment 15 was constructed to be approximately 3 inches, and the diameter of inner segment 14 was constructed to be approximately 2 inches. The innermost segments were constructed to be approximately 1 ¼ inches in diameter, and the central opening was constructed to be approximately three eighths of an inch in diameter.

The longest dimension of the device measured along line 3—3 of FIG. 2, which includes the length of tab 11, was preferably constructed to be 3 ¾ inches. A device constructed from these dimensions was found to be very adaptable to most commonly manufactured lids for conventional containers.

Figure 3:
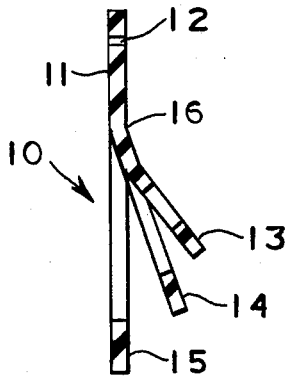
FIG. 3 is a cross-sectional view, taken through section 3—3 of FIG. 2.
Figure 4:
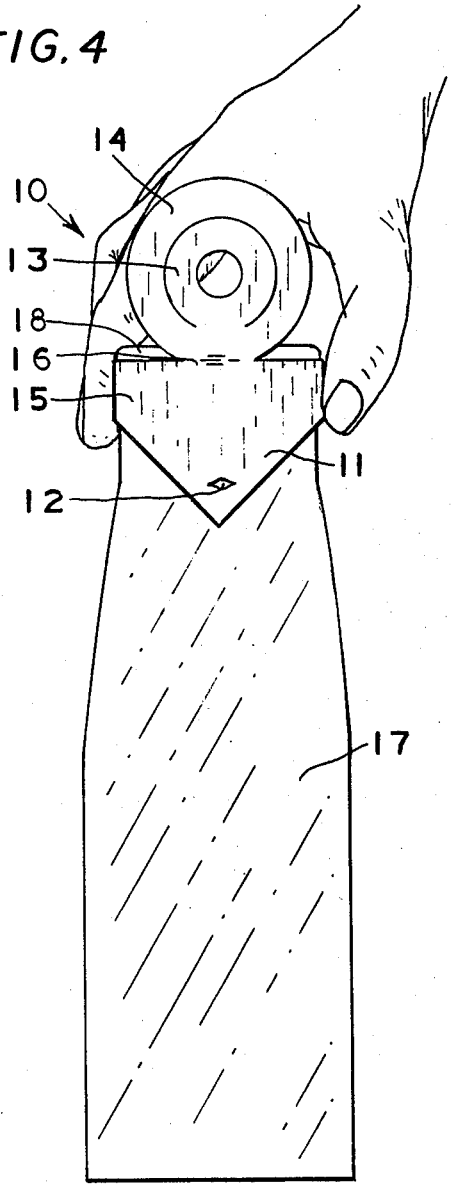
FIG. 4 illustrates the application of the lid-removing device on a lid covering a container.
Figure 5:
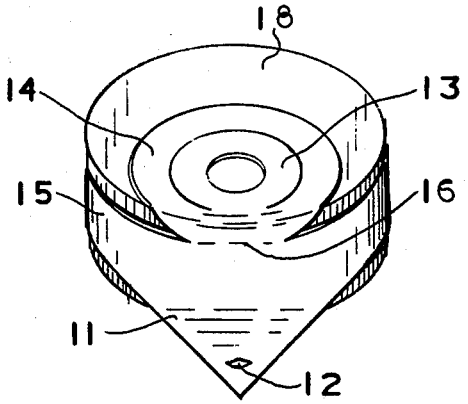
FIG. 5 is a perspective view, showing the device applied to a lid, after it has been removed from the container.

Referring to FIGS. 3, 4 and 5, the device is shown applied to a larger diameter lid 18, which is threadably connected to the top of container 17. In application, the user stretches outer circular segment 15 over the side walls of the lid until a snug, non-slip fit is achieved. The inner circular segments 13 and 14 can be pushed out of the way or bent upwardly, as shown in FIG. 4. The lid then has an outer periphery of a rubber, non-skid, circular segment completely surrounding its outer surface, so that the user merely grips the side walls of the lid with his fingers or palm, to open the lid from the jar. It is obvious that lids of smaller diameters can be accommodated by the inner circular segments 13 and 14. The resiliency of the rubber sheet, from which the device according to the invention is constructed, permits lids of a wide variety of diameters to be accommodated, which are in excess of the diameter of outer circular segment 15.

While only a single embodiment of the present invention has been shown and described, it will be obvious that many changes and modifications may be made thereunto, without departing from the spirit and scope of the invention.

I claim:

1. A lid-removing device for removing lids having a top wall and a peripheral wall depending therefrom, from containers, comprising:

a flat, resilient, elastic sheet of material having a plurality of concentrically-arranged, substantially C-shaped slits formed therethrough which define therebetween annular segments, each of which serve to grip lids of different diameters, the ends of each slit defining an unslit hinge portion therebetween which integrally joins adjacent annular segments to one another, said hinge portions permitting pivoting of said annular segments relative to one another so that one of said annular elements may be pivoted downwardly to encircle the periphery of a container lid in flat, abutting and non-skid engagement with the lateral peripheral wall thereof while the annular segments disposed inwardly of said engaged annular element are pivotably upwardly such that they are disposed normal to the top wall of said lid; and a tab integrally coupled to, and projecting outwardly from and in the same plane as, the outermost annular segment of said sheet of material.

2. The lid-removing device according to claim 1, wherein the innermost annular segment has a central bore formed therethrough, wherein said hinge portions defined between said ends of said C-shaped slits are aligned so as to define a continuous, uninterrupted linear segment which integrally joins said segments together, and wherein said tab has anaperture formed therethrough.

3. The lid-removing device according to claim 1, wherein said device has three annular segments.

4. The lid-removing device according to claim 1, wherein said flat sheet of material has a generally circular configuration and where said tab has a generally triangular configuration.

* * * * *